US008511972B2

(12) United States Patent
Sutcu

(10) Patent No.: US 8,511,972 B2
(45) Date of Patent: Aug. 20, 2013

(54) SEAL MEMBER FOR USE IN A SEAL SYSTEM BETWEEN A TRANSITION DUCT EXIT SECTION AND A TURBINE INLET IN A GAS TURBINE ENGINE

(75) Inventor: Muzaffer Sutcu, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1165 days.

(21) Appl. No.: 12/639,371

(22) Filed: Dec. 16, 2009

(65) Prior Publication Data

US 2011/0140370 A1 Jun. 16, 2011

(51) Int. Cl.
*F02C 7/28* (2006.01)

(52) U.S. Cl.
USPC ..... 415/139; 277/644; 60/799

(58) Field of Classification Search
USPC ..... 60/752, 39.37, 796, 797, 798, 799, 60/800; 277/644, 630, 637, 649, 652; 415/126, 415/127, 134, 139
See application file for complete search history.

(56) References Cited

U.S. PATENT DOCUMENTS

| | | | | | |
|---|---|---|---|---|---|
| 3,609,968 | A | | 10/1971 | Mierley, Sr. et al. | |
| 3,938,906 | A | * | 2/1976 | Michel et al. | 415/139 |
| 4,016,718 | A | | 4/1977 | Lauck | |
| 4,433,848 | A | * | 2/1984 | Williams | 277/547 |
| 4,477,057 | A | * | 10/1984 | Friess | 251/306 |
| 4,917,302 | A | | 4/1990 | Steinetz et al. | |
| 5,014,917 | A | | 5/1991 | Sirocky et al. | |
| 5,076,590 | A | | 12/1991 | Steinetz et al. | |
| 5,082,293 | A | | 1/1992 | Steinetz et al. | |
| 5,236,202 | A | * | 8/1993 | Krouth et al. | 277/644 |
| 5,265,412 | A | | 11/1993 | Bagepalli et al. | |
| 5,400,586 | A | | 3/1995 | Bagepalli et al. | |
| 5,433,456 | A | * | 7/1995 | Nicholson | 277/644 |
| 5,749,218 | A | | 5/1998 | Cromer et al. | |
| 5,761,898 | A | | 6/1998 | Barnes et al. | |
| 5,915,697 | A | | 6/1999 | Bagepalli et al. | |
| 5,934,687 | A | | 8/1999 | Bagepalli et al. | |
| 6,039,325 | A | | 3/2000 | Steinetz et al. | |
| 6,199,871 | B1 | * | 3/2001 | Lampes | 277/614 |
| 6,345,494 | B1 | | 2/2002 | Coslow | |
| 6,418,727 | B1 | * | 7/2002 | Rice et al. | 60/799 |
| 6,450,762 | B1 | | 9/2002 | Munshi | |
| 6,502,825 | B2 | | 1/2003 | Aksit et al. | |
| 6,537,023 | B1 | | 3/2003 | Aksit et al. | |
| 6,547,257 | B2 | | 4/2003 | Cromer | |
| 6,619,915 | B1 | | 9/2003 | Jorgensen | |
| 6,648,333 | B2 | | 11/2003 | Aksit et al. | |

(Continued)

OTHER PUBLICATIONS

U.S. Appl. No. 12/547,932, filed Aug. 26, 2009, Sutcu.

*Primary Examiner* — Nathaniel Wiehe
*Assistant Examiner* — Ryan Ellis

(57) ABSTRACT

A seal member for use in a channel between a transition seal structure and a vane seal structure in a gas turbine engine. The seal member includes a spring member and a sheathing assembly. A first end of the spring member is affixed to either the transition seal structure or the vane seal structure. The second end is free to move within the channel. The sheathing assembly includes a main body and a plate portion. The main body surrounds the spring member and is affixed to the second end thereof. The plate portion extends from the main body and is adapted to extend toward the other of the transition seal structure and the vane seal structure. The spring member provides a bias on the sheathing assembly such that the plate portion engages the other of the transition seal structure and the vane seal structure to limit leakage through the channel.

20 Claims, 9 Drawing Sheets

(56) References Cited

U.S. PATENT DOCUMENTS

| | | | | |
|---|---|---|---|---|
| 6,659,472 | B2 | 12/2003 | Aksit et al. | |
| 6,662,567 | B1 | 12/2003 | Jorgensen | |
| 6,675,584 | B1 | 1/2004 | Hollis et al. | |
| 6,942,220 | B2 * | 9/2005 | Takahiro et al. | 277/603 |
| 7,090,224 | B2 | 8/2006 | Iguchi et al. | |
| 2002/0121744 | A1 | 9/2002 | Aksit et al. | |
| 2004/0031271 | A1 | 2/2004 | Jorgensen | |
| 2008/0053107 | A1 | 3/2008 | Weaver et al. | |

* cited by examiner

SEAL MEMBER FOR USE IN A SEAL SYSTEM BETWEEN A TRANSITION DUCT EXIT SECTION AND A TURBINE INLET IN A GAS TURBINE ENGINE

FIELD OF THE INVENTION

The present invention relates to a seal member for use in a seal system in a gas turbine engine, and, more particularly, to a seal member for use in a seal system between a transition duct exit section and a first row vane assembly at an inlet into a turbine section.

BACKGROUND OF THE INVENTION

A conventional combustible gas turbine engine includes a compressor section, a combustion section including a plurality of combustors, and a turbine section. Ambient air is compressed in the compressor section and conveyed to the combustors in the combustion section. The combustors combine the compressed air with a fuel and ignite the mixture creating combustion products defining hot working gases that flow in a turbulent manner and at a high velocity. The working gases are routed to the turbine section via a plurality of transition ducts. Within the turbine section are rows of stationary vane assemblies and rotating blade assemblies. The rotating blade assemblies are coupled to a turbine rotor. As the working gases expand through the turbine section, the working gases cause the blades assemblies, and therefore the turbine rotor, to rotate. The turbine rotor may be linked to an electric generator, wherein the rotation of the turbine rotor can be used to produce electricity in the generator.

The transition ducts are positioned adjacent to the combustors and route the working gases into the turbine section through turbine inlet structure associated with a first row vane assembly. Because the transition ducts and the turbine inlet structure are formed from different materials, they experience different amounts of thermal growth. That is, both the transition ducts and the turbine inlet structure may move radially, circumferentially, and/or axially relative to one another as a result of thermal growth of the respective components. Thus, seal assemblies are typically used in gas turbine engines between the transition ducts and the turbine inlet structure to minimize leakage between the working gases passing into the turbine section and cooling air, i.e., cold compressor discharge air, which is used to cool structure within the gas turbine engine.

SUMMARY OF THE INVENTION

In accordance with a first aspect of the present invention, a seal member is provided in a channel between a transition seal structure associated with a transition duct and a vane seal structure associated with a vane structure in a first row vane assembly of a gas turbine engine. The seal member comprises a first spring member and a sheathing assembly. The first spring member extends in a circumferential direction within the channel. The first spring member comprises a first end portion and a second end portion spaced apart from the first end portion in the circumferential direction. The first end portion is affixed to a first one of the transition seal structure and the vane seal structure. The second end portion is free to move circumferentially within the channel with respect to the transition seal structure and the vane seal structure. The sheathing assembly comprises a main body portion and a plate portion. The main body portion is disposed about at least a substantial portion of the first spring member and is affixed to the second end portion of the first spring member. The plate portion extends from the main body portion toward a second one of the transition seal structure and the vane seal structure different than the first one of the transition seal structure and the vane seal structure. The first spring member provides a bias on the sheathing assembly such that the plate portion engages the second one of the transition seal structure and the vane seal structure to limit leakage through the channel between the transition seal structure and the vane seal structure.

In accordance with a second aspect of the present invention, a seal apparatus is provided in a gas turbine engine between a transition duct and a vane structure in a first row vane assembly. The seal apparatus comprises a transition seal structure associated with the transition duct, a vane seal structure associated with the vane structure, and a seal member. The transition seal structure and the vane seal structure are positioned so as to define a circumferentially extending channel therebetween. The seal member is located in the channel between the transition seal structure and the vane seal structure for limiting leakage through the channel and comprises a first spring member and a sheathing assembly. The first spring member has a first end portion and a second end portion spaced apart from the first end portion in the circumferential direction. The first end portion is affixed to a first one of the transition seal structure and the vane seal structure. The second end portion is free to move circumferentially within the channel with respect to the transition seal structure and the vane seal structure. The sheathing assembly is associated with the first spring member and is affixed to the second end portion of the first spring member. The sheathing assembly includes a circumferentially extending plate portion, wherein the first spring member provides a bias on the sheathing assembly such that the plate portion engages the other of the transition seal structure and the vane seal structure to limit leakage through the channel between the transition seal structure and the vane seal structure.

In accordance with a third aspect of the present invention, a seal member is provided for use in a channel between a transition seal structure associated with a transition duct and a vane seal structure associated with a vane structure in a first row vane assembly of a gas turbine engine. The seal member comprises a first spring member and a sheathing assembly. The first spring member comprises a first end portion and a second end portion spaced apart from the first end portion. The first end portion is adapted to be affixed to a first one of the transition seal structure and the vane seal structure. The second end portion is free to move circumferentially when disposed within the channel with respect to the transition seal structure and the vane seal structure. The sheathing assembly comprises a main body portion and a plate portion. The main body portion is disposed about at least a substantial portion of the first spring member and is affixed to the second end portion of the first spring member. The plate portion extends from the main body portion and is adapted to extend toward a second one of the transition seal structure and the vane seal structure different than the first one of the transition seal structure and the vane seal structure. The first spring member is adapted to provide a bias on the sheathing assembly such that the plate portion engages the second one of the transition seal structure and the vane seal structure to limit leakage through the channel between the transition seal structure and the vane seal structure.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
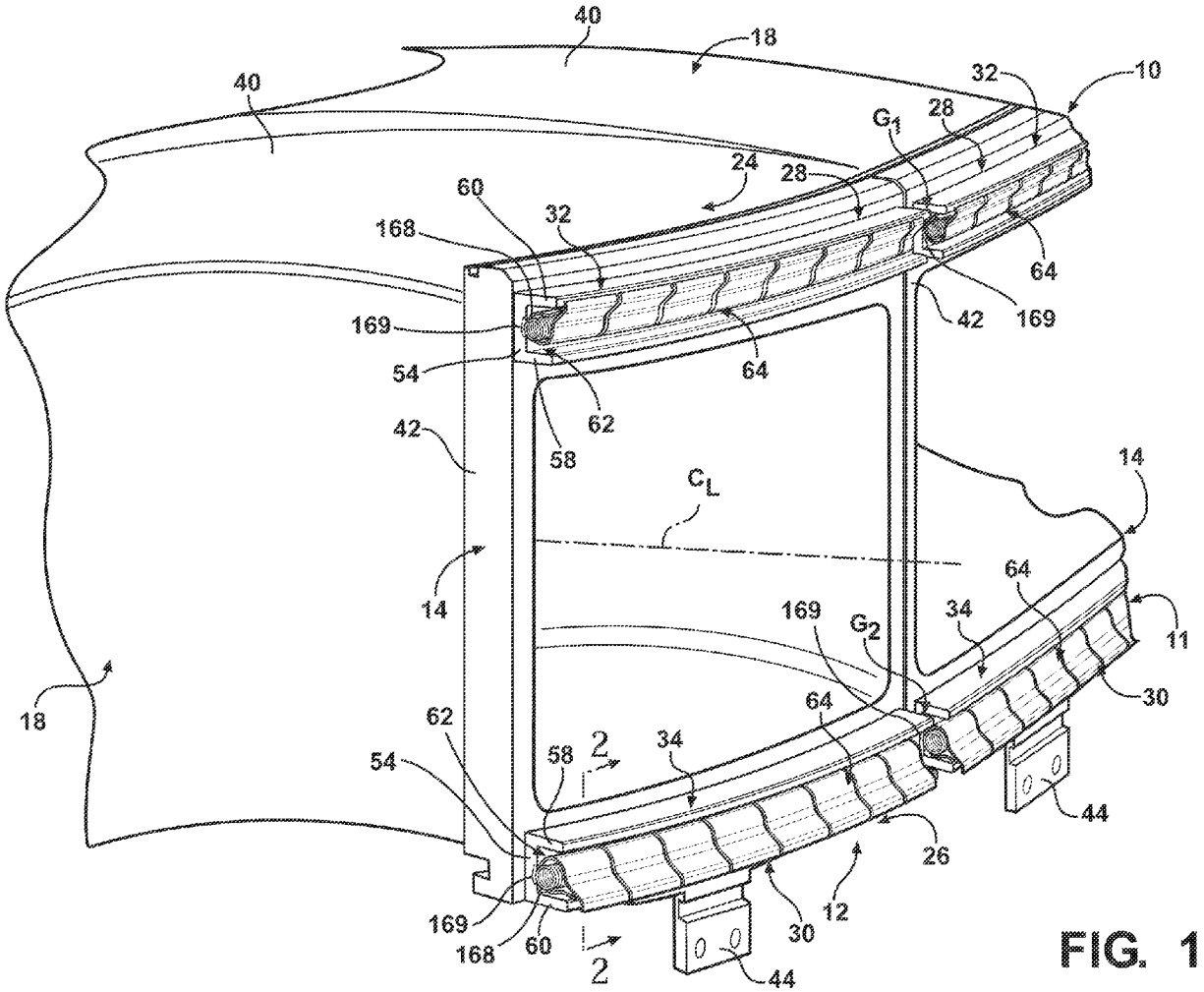
FIG. 1 is a fragmentary perspective view illustrating a plurality of transition ducts including transition seal structures of seal systems according to embodiments of the invention.

Referring to FIG. 1, portions of a radially inner seal system 10 and portions of a radially outer seal system 11 according to embodiments of the invention are shown. The seal systems 10, 11 are adapted for use in a gas turbine engine between a transition exit section 12 defined by a plurality of transition duct exits 14 and a first row vane assembly 15 (see FIG. 3) located proximate to a turbine inlet 16.

Working gases are routed from combustors (not shown) to the turbine inlet 16 through a plurality of transition ducts 18, each transition duct 18 having an associated exit 14. The working gases expand in a turbine section 20 (FIG. 3) commencing at the turbine inlet 16 and cause blades (not shown) coupled to a shaft and disc assembly (not shown) to rotate. It is noted that not all of the transition ducts 18 that would typically be employed in an engine are shown in FIG. 1. That is, in a given engine, an annular array of transition ducts 18 would typically be employed, such that the transition exit section 12 would be defined by a substantially continuous ring of circumferentially adjacent transition duct exits 14. However, since the other transition ducts 18 employed in the engine would be substantially similar to those illustrated in FIG. 1, only a select few of the transition ducts 18 are illustrated in FIG. 1 for clarity.

The seal systems 10, 11 comprise annular seal systems 10, 11 that are located between the transition duct exits 14 and the first row vane assembly 15. The seal systems 10, 11 limit leakages of fluids between a hot gas path 22 (see FIG. 3) that passes through the turbine section 20 and respective radially inner and outer areas 24, 26 (see FIGS. 1 and 3) that contain cooling fluid for cooling structure to be cooled within the engine. That is, the seal systems 10, 11 limit leakage of the hot working gases in the hot gas path 22 into each of the areas 24, 26, and also limit leakage of the cooling fluid in the areas 24, 26 into the hot gas path 22.

Figure 3:
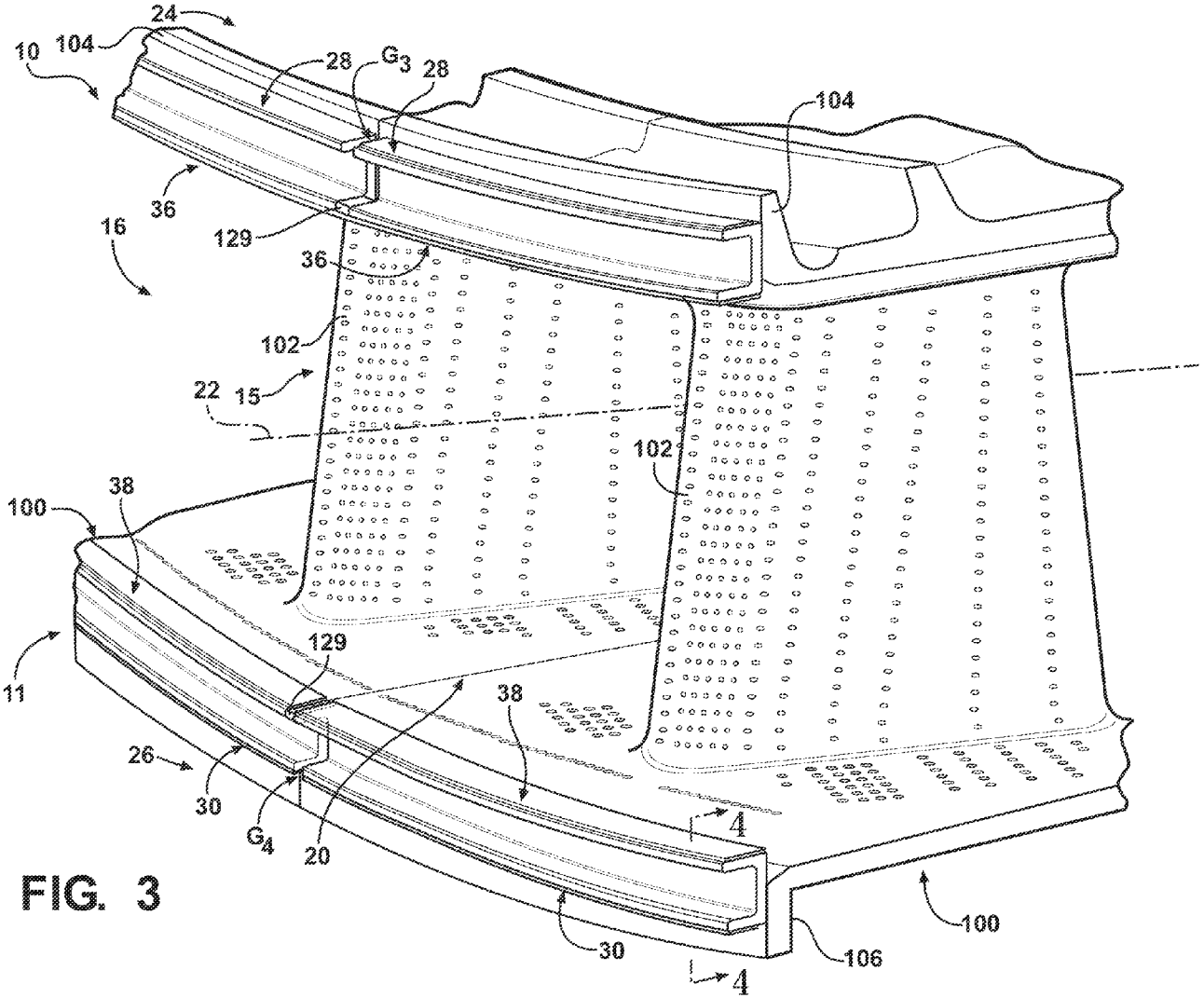
FIG. 3 is a fragmentary perspective view illustrating a plurality of vane structures of a first row vane assembly including vane seal structures of seal systems according to embodiments of the invention.

Referring to FIGS. 1 and 3, the radially inner seal system 10 comprises a plurality of circumferentially adjacent radially inner seal apparatuses 28 and the radially outer seal system 11 comprises a plurality of circumferentially adjacent radially outer seal apparatuses 30. Each seal apparatus 28, 30 includes one or more transition seal structures 32, 34 (FIG. 1), respectively, which transition seal structures 32, 34 are associated with the transition duct exits 14. Each seal apparatus 28, 30 further includes one or more vane seal structures 36, 38 (see FIG. 3), respectively, which vane seal structures 36, 38 are associated with the first row vane assembly 15, as will be described herein. The seal apparatuses 28, 30 are located between the transition duct exits 14 and the first row vane assembly 15 to collectively form the respective seal systems 10, 11.

Each of the transition ducts 18 is associated with one or more of each of the transition seal structures 32, 34, and, in the embodiment shown, each of the transition ducts 18 is associated with one of the transition seal structures 32 and one of the transition seal structures 34. It is noted that the transition ducts 18 and their associated transition seal structures 32, 34 are substantially similar to each other. Further, the transition seal structures 32, 34 are substantial mirror images of one another, i.e., about a centerline $C_L$ of each of the transition ducts 18, with the exception of the transition seal structures 34 having a greater circumferential length than the transition seal structures 32, which greater circumferential length results from the radially outer seal system 11 having a greater overall diameter than the radially inner seal system 10. Hence, only a single transition duct 18 (see FIG. 2) and its associated transition seal structure 34 (see FIG. 2) will be described in detail herein. It is understood that the other transition ducts 18 and their associated transition seal structures 32, 34 may be constructed in the same manner as the transition duct 18 and its transition seal structure 34 described herein, with the transition seal structures 32 being mirrored horizontally about the respective centerline $C_L$ from the described transition seal structure 34.

The transition duct 18 in the embodiment shown comprises a substantially tubular duct panel structure 40 and an associated transition exit flange 42. The duct panel structure 40 is coupled, via bracket structure 44, to structure (not shown)

affixed to a compressor exit casing (not shown), and defines a flow path for the hot working gases passing from an associated combustor into the turbine section 20. The transition exit flange 42 extends about an opening defined by an outlet end of the duct panel structure 40 and defines the exit 14 of the transition duct 18.

Figure 2:
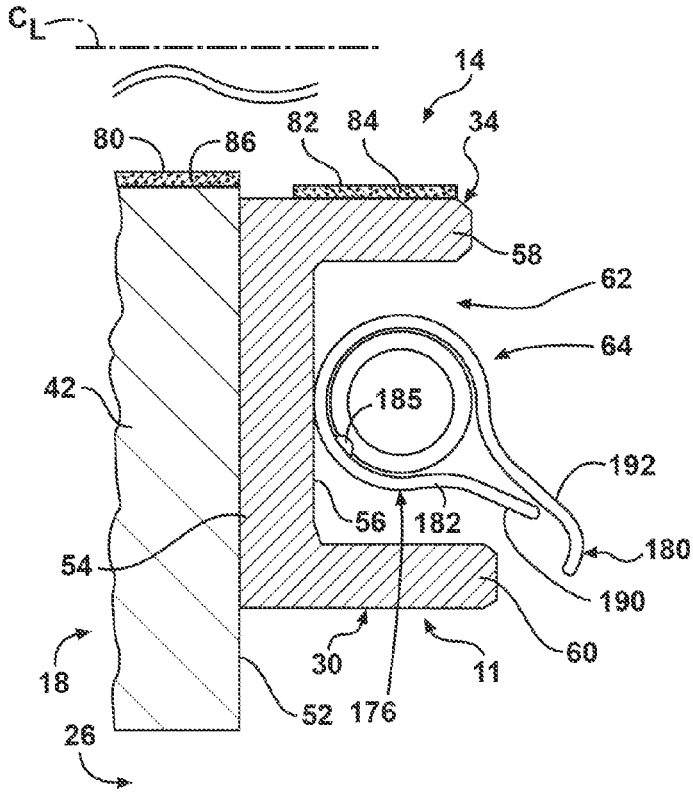
FIG. 2 is a cross sectional view taken along line 2-2 in FIG. 1, illustrating a portion of one of the transition ducts illustrated in FIG. 1 and its corresponding transition seal structure.

In the embodiment shown in FIG. 2, the transition seal structure 34 is affixed to an axially facing surface 52 of the exit flange 42. Any suitable method that produces a coupling capable of functioning in the high temperature environment of the transition exit/turbine inlet may be used to couple the transition seal structure 34 to the exit flange 42, such as, for example, using an affixation structure, such as a bolt or pin, welding, etc. It is noted that the exit flange 42 and the transition seal structure 34 could be integrally formed as a single structure without departing from the spirit and scope of the invention.

The transition seal structure 34 comprises a transition base portion 54 associated with the transition duct 18, i.e., mounted to the axially facing surface 52 of the transition exit flange 42, see FIG. 2. The transition base portion 54 defines a first axially facing surface 56 of the transition seal structure 34. The transition seal structure 34 further comprises a first transition lip member 58, i.e., a radially inner transition lip member, which extends axially from the first axially facing surface 56 of the transition base portion 54. The transition seal structure 34 further comprises a second transition lip member 60, i.e., a radially outer transition lip member, which is radially spaced from the first transition lip member 58 and extends axially from the first axially facing surface 56 of the transition base portion 54.

A transition channel 62 is located between the first transition lip member 58, the second transition lip member 60, and the transition base portion 54. In the embodiment shown in FIG. 2, a seal member 64 extends circumferentially within the transition channel 62 for limiting a leakage of fluids through the seal apparatus 30. Additional details in connection with the seal member 64 will be discussed in detail below.

As shown in FIG. 2, the transition duct 18 comprises a first radially facing surface 80 that faces the centerline $C_L$ of the transition duct 18. The first radially facing surface 80 is exposed to the hot working gases flowing through the transition duct 18 on their way into the turbine section 20. The transition seal structure 34, i.e., the first transition lip member 58 thereof, comprises a second radially facing surface 82 that faces the centerline $C_L$ of the transition duct 18, and is located radially further from the centerline $C_L$ of the transition duct 18 than is the first radially facing surface 80 of the transition duct 18.

As shown in FIG. 2, the second radially facing surface 82 may comprise a thermal barrier coating (TBC) 84, which thermal barrier coating 84 may be more tolerant to the high temperatures of the hot working gases exiting the transition duct 18 than the material forming the transition seal structure 34, thus increasing a lifespan of the transition seal structure 34, as will be discussed below. Further, the first radially facing surface 80 of the transition duct 18 may comprise a thermal barrier coating 86, which thermal barrier coating 86 may be more tolerant to the high temperatures of the hot working gases exiting the transition duct 18 than the material forming the transition duct 18, thus increasing a lifespan of the transition duct 18.

Referring now to FIG. 3, a plurality of vane structures 100 of the first row vane assembly 15 are shown. Each of the vane structures 100 is associated with one or more of each of the vane seal structures 36, 38, and, in the embodiment shown, each vane structure 100 is associated with one of the vane seal structures 36 and with one of the vane seal structures 38. The vane seal structures 36, 38 associated with the vane structures 100 cooperate with respective ones of the transition seal structures 32, 34 associated with the transition ducts 18 to form the seal apparatuses 28, 30 of the seal systems 10, 11.

It is noted that the vane structures 100 and their associated vane seal structures 36, 38 are substantially similar to one another. Further, the vane seal structures 36, 38 are substantial mirror images of one another, i.e., about the centerline $C_L$ of the transition ducts 18. Hence, only a single vane structure 100 (see FIG. 4) and its associated vane seal structure 38 (see FIG. 4) will be described in detail herein. It is understood that the other vane structures 100 and their associated vane seal structures 36, 38 may be constructed in the same manner as the vane structure 100 and its radially outer vane seal structure 38 described herein, with the vane seal structures 36 being mirrored horizontally about the centerline $C_L$ from the described vane seal structure 38.

The vane structures 100 in the embodiment shown in FIG. 3 comprise a vane member 102 and associated radially inner and radially outer vane flanges 104, 106. The vane structures 100 are coupled to an engine casing via mounting hardware (not shown).

Figure 4:
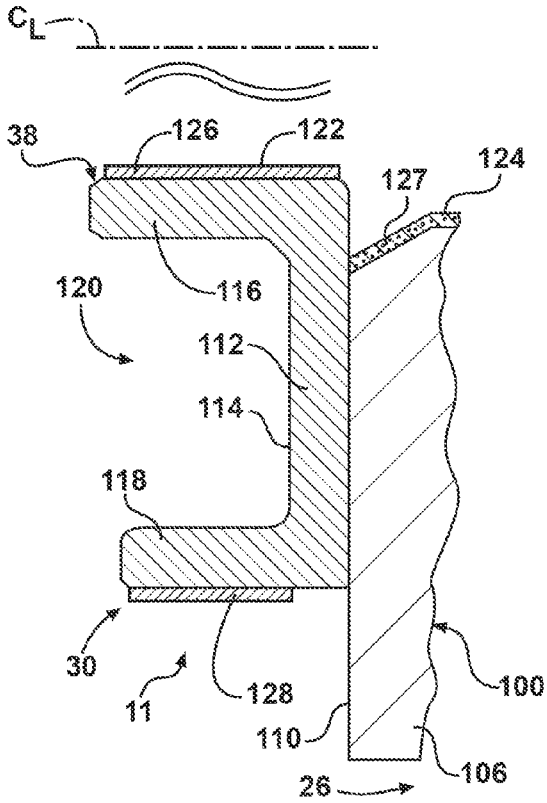
FIG. 4 is a cross sectional view taken along line 4-4 in FIG. 3, illustrating a portion of one of the vane structures illustrated in FIG. 3 and its corresponding vane seal structure.

In the embodiment shown in FIG. 4, the vane seal structure 38 is affixed to an axially facing surface 110 of the radially outer vane flange 106. Any suitable method that produces a coupling capable of functioning in the high temperature environment of the transition exit/turbine inlet may be used to couple the vane seal structure 38 to the vane flange 106, such as, for example, using an affixation structure, such as a bolt or pin, welding, etc. It is noted that the vane flange 106 and the vane seal structure 38 could be integrally formed as a single structure without departing from the spirit and scope of the invention.

The vane seal structure 38 comprises a vane base portion 112 associated with the vane structure 100, i.e., mounted to the axially facing surface 110 of the vane flange 106. The vane base portion 112 defines a second axially facing surface 114 of the vane seal structure 38. The vane seal structure 38 further comprises a first vane lip member 116, i.e., a radially inner vane lip member, which extends axially from the second axially facing surface 114 of the vane base portion 112. The vane seal structure 38 further comprises a second vane lip member 118, i.e., a radially outer vane lip member, which is radially spaced from the first vane lip member 116 and extends axially from the second axially facing surface 114 of the vane base portion 112.

Figure 9:
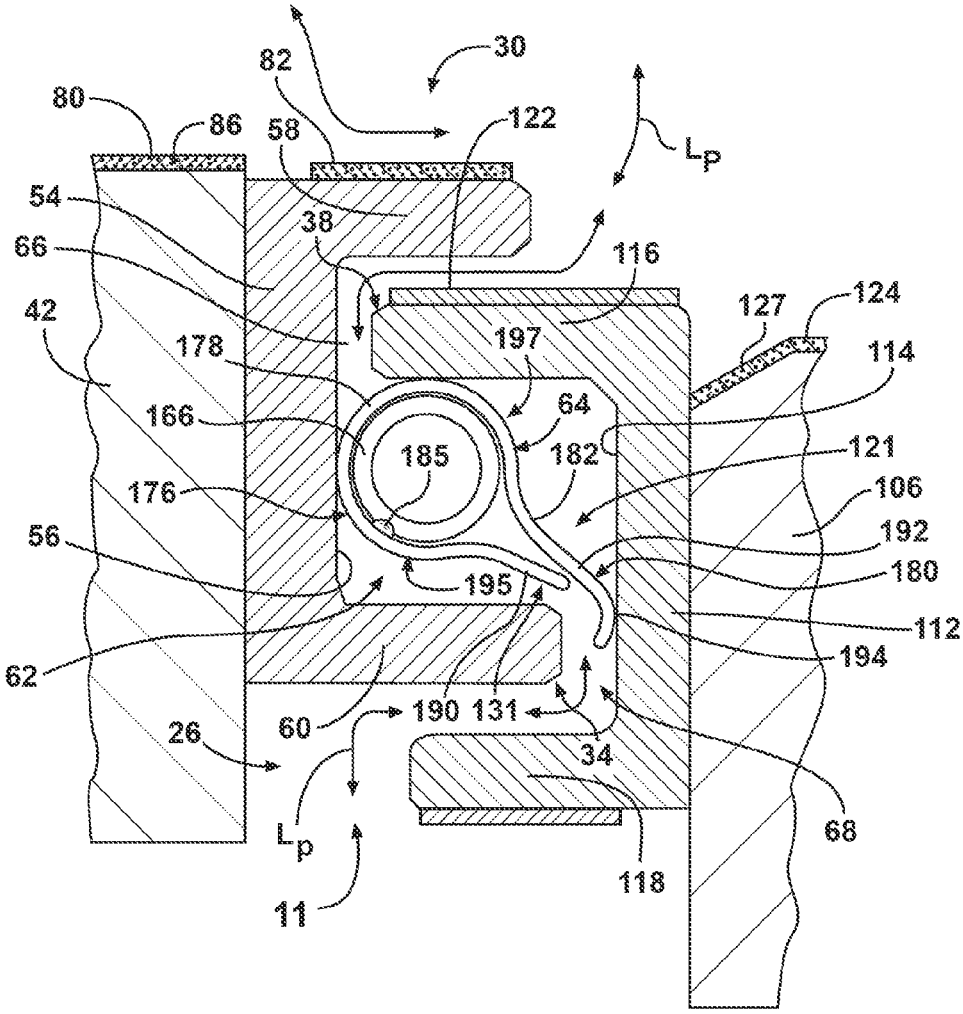
FIG. 9 is a cross sectional view of the transition seal structure illustrated in FIG. 2 cooperating with the vane seal structure illustrated in FIG. 4 and the seal member of FIGS. 5-8 to form a seal apparatus of a seal system according to an embodiment of the invention.

A vane channel 120 is located between the first vane lip member 116, the second vane lip member 118, and the vane base portion 112. Referring to FIG. 9, when the seal apparatus 30 is assembled, the seal member 64 is disposed in a common channel 121, which will be discussed below, formed by the transition channel 62 and the vane channel 120 for limiting the leakage of fluids through the seal apparatus 30, as will be discussed in detail herein.

Referring back to FIG. 4, the vane seal structure 38, i.e., the first vane lip member 116 thereof, comprises a third radially facing surface 122 that faces the centerline $C_L$ of the transition duct 18. The vane structure 100 comprises a fourth radially facing surface 124 that faces the centerline $C_L$ of the transition duct 18. The fourth radially facing surface 124 of the vane structure 100 is located radially further from the centerline $C_L$ of the transition duct 18 than is the third radially facing surface 122 of the vane seal structure 38. Thus, the third and fourth radially facing surfaces 122, 124 create a "waterfall effect" for the hot working gases flowing into the turbine section 20, such that exposure of the fourth radially facing surface 124 to the hot working gases is reduced. The reduced exposure of the fourth radially facing surface 124 to the hot working gases may increase the lifespan of the vane structure 100. Further, the "waterfall effect" reduces impingement of the hot working gases flowing into the turbine section 20, since the vane structure 100 does not extend into/block the hot working gases flowing into the turbine section 20. It is noted that, since the vane seal structure 38 is directly affixed to the vane structure 100, relative radial movement between the vane seal structure 38 and the vane structure 100 does not occur. Thus, the fourth radially facing surface 124 of the vane structure 100 is prevented at all times from being located closer to the centerline $C_L$ of the transition duct 18 than the third radially facing surface 122 of the vane seal structure 38, which creates a positive "waterfall effect" between the third and fourth radially facing surface 122, 124 at all times during operation of the engine.

Moreover, as shown in FIG. 9, the third radially facing surface 122 of the vane seal structure 38 is located radially further from the centerline $C_L$ of the transition duct 18 than is the second radially facing surface 82 of the transition seal structure 34. Thus, the second and third radially facing surfaces 82, 122 create a "waterfall effect" for the hot working gases flowing into the turbine section 20, such that exposure of the third radially facing surface 122 to the hot working gases is reduced. Further, the "waterfall effect" reduces impingement of the hot working gases flowing into the turbine section 20, since the vane seal structure 38 does not extend into/block the hot working gases flowing out of the transition exit 14 and into the turbine section 20.

As shown in FIG. 4, the third radially facing surface 122 of the vane seal structure 38 may comprise an abradable coating 126, which abradable coating 126 may comprise a sacrificial layer in the case of contact between the first vane lip member 116 and the first transition lip member 58 (FIG. 9), thus further increasing a lifespan of the vane seal structure 38. Additionally, the fourth radially facing surface 124 of the vane structure 100 may comprise a thermal barrier coating 127, which thermal barrier coating 127 may be more tolerant to the high temperatures of the hot working gases entering the turbine section 20 than the material forming the vane structure 100, thus increasing a lifespan of the vane structure 100. Further, the second vane lip member 118 may comprise an abradable coating 128 in the case of contact between the second vane lip member 118 and the second transition lip member 60 (FIG. 9). The abradable coating 128 may comprise a sacrificial layer so as to prevent damage to the lip members 60, 118.

As noted above, the additional transition seal structures 32, 34 and the additional vane seal structures 36, 38 may be constructed in the same manner as the described transition seal structure 34 and vane seal structure 38. However, also noted above, the transition seal structures 32 and the vane seal structures 36 may be mirror images of the transition seal structure 34 and the vane seal structure 38 described in detail herein. For example, the seal members 64 disposed between the transition seal structures 32 and the vane seal structures 36 may be oriented in the opposite direction than that described for the transition seal structure 34 and the vane seal structure 38.

Referring back to FIG. 1, first gaps $G_1$ are formed between circumferentially adjacent transition seal structures 32. The first gaps $G_1$ permit the transition ducts 18 and transition seal structures 32 to thermally expand, which thermal expansion may occur during operation of the engine, without contact between adjacent transition seal structures 32. Further, second gaps $G_2$, which may be circumferentially aligned with the first gaps $G_1$, are formed between circumferentially adjacent transition seal structures 34. The second gaps $G_2$ permit the transition ducts 18 and transition seal structures 34 to thermally expand, which thermal expansion may occur during operation of the engine, without contact between adjacent transition seal structures 34.

Referring to FIG. 3, third gaps $G_3$ are formed between circumferentially adjacent vane seal structures 36. The third gaps $G_3$ permit the vane structures 100 and vane seal structures 36 to thermally expand, which thermal expansion may occur during operation of the engine, without contact between adjacent vane seal structures 36. Further, fourth gaps $G_4$, which may be circumferentially aligned with the third gaps $G_3$, are formed between circumferentially adjacent vane seal structures 38. The fourth gaps $G_4$ permit the vane structures 100 and vane seal structures 38 to thermally expand, which thermal expansion may occur during operation of the engine, without contact between adjacent vane seal structures 38.

Figure 10:
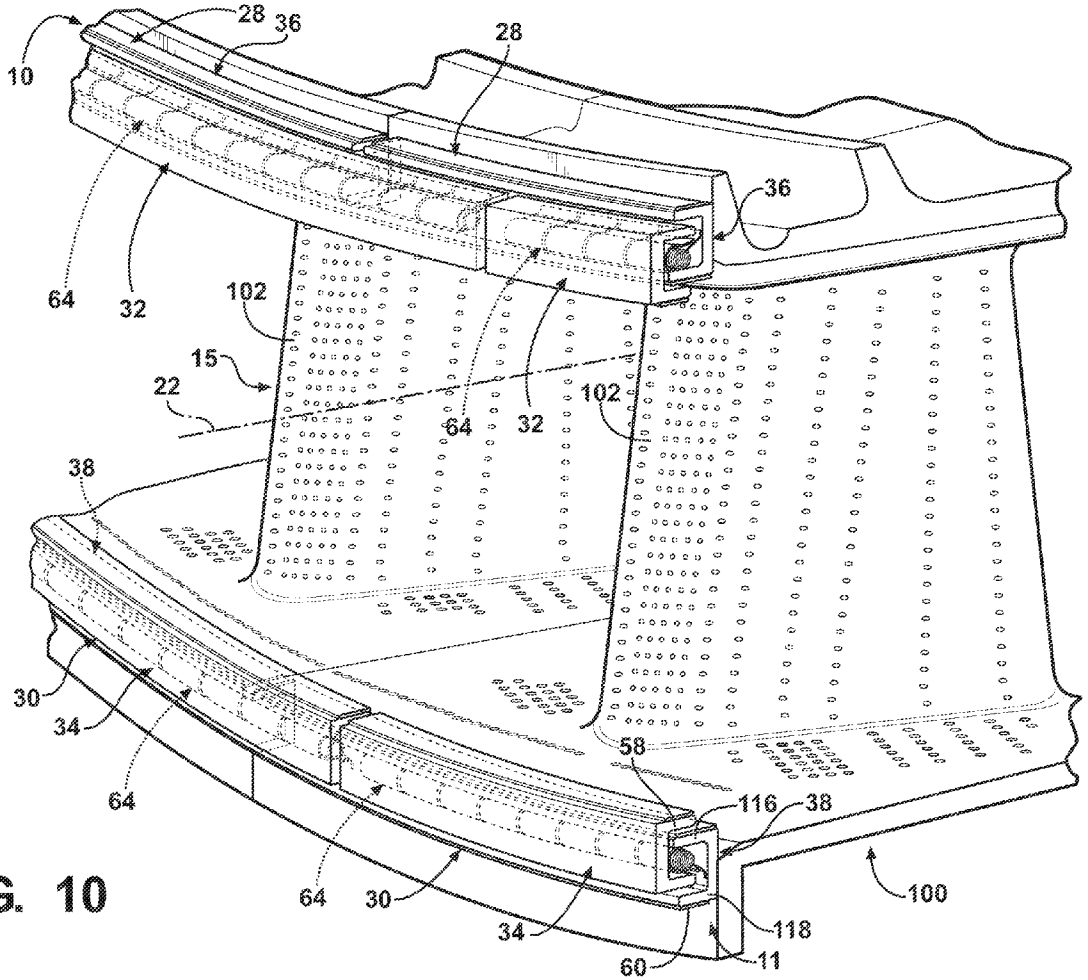
FIG. 10 is a fragmentary perspective view of a plurality of the transition seal structures illustrated in FIG. 1, shown removed from their corresponding transition ducts, cooperating with a plurality of the vane seal structures illustrated in FIG. 3 and with a plurality of the seal members of FIGS. 5-8 to form seal apparatuses of seal systems according to embodiments of the invention.

It is noted that, in a preferred embodiment, the gaps $G_1$, $G_2$ do not circumferentially align with the gaps $G_3$, $G_4$, such that direct flow paths though the respective gaps $G_1$, $G_3$, and $G_2$, $G_4$ are not formed (see FIG. 10). Further, as shown in FIG. 3, sealing members 129, such as, for example, dog bone seals, may span between circumferentially adjacent vane seal structures 36, 38 to block the gaps $G_3$, $G_4$ and thus limit leakage through the seal systems 10, 11.

Figure 5:
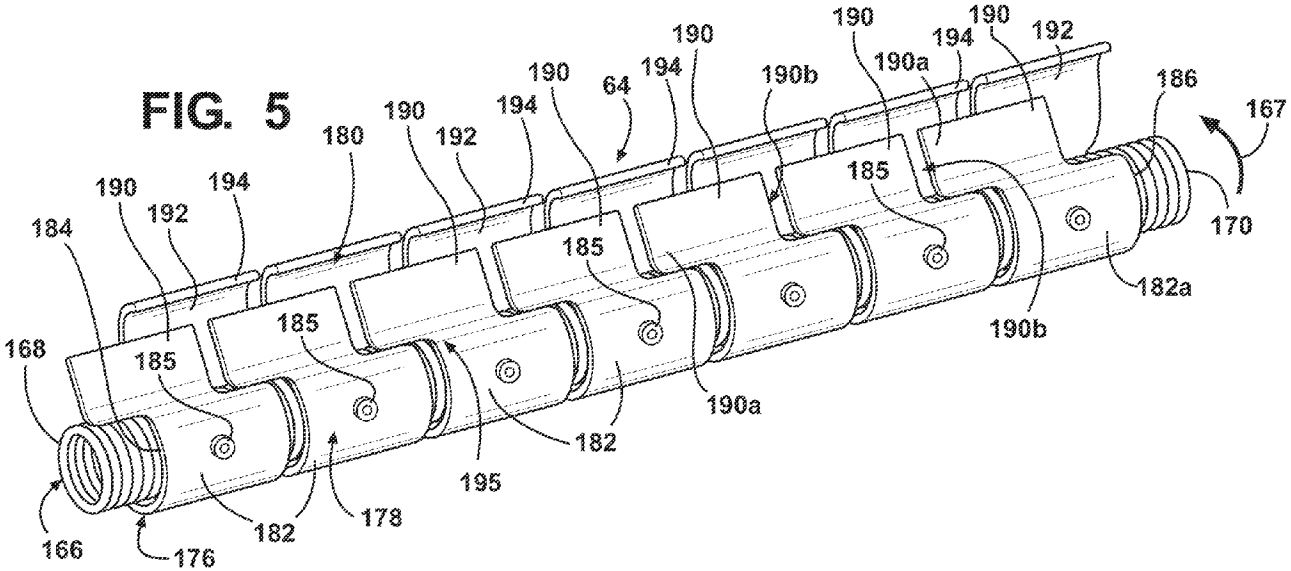
FIG. 5 is a perspective view illustrating a first side of a seal member according to an embodiment of the invention and shown in a first position, the seal member adapted for implementation between one or more of the transition seal structures illustrated in FIG. 1 and one or more of the vane seal structures illustrated in FIG. 3.
Figure 6:
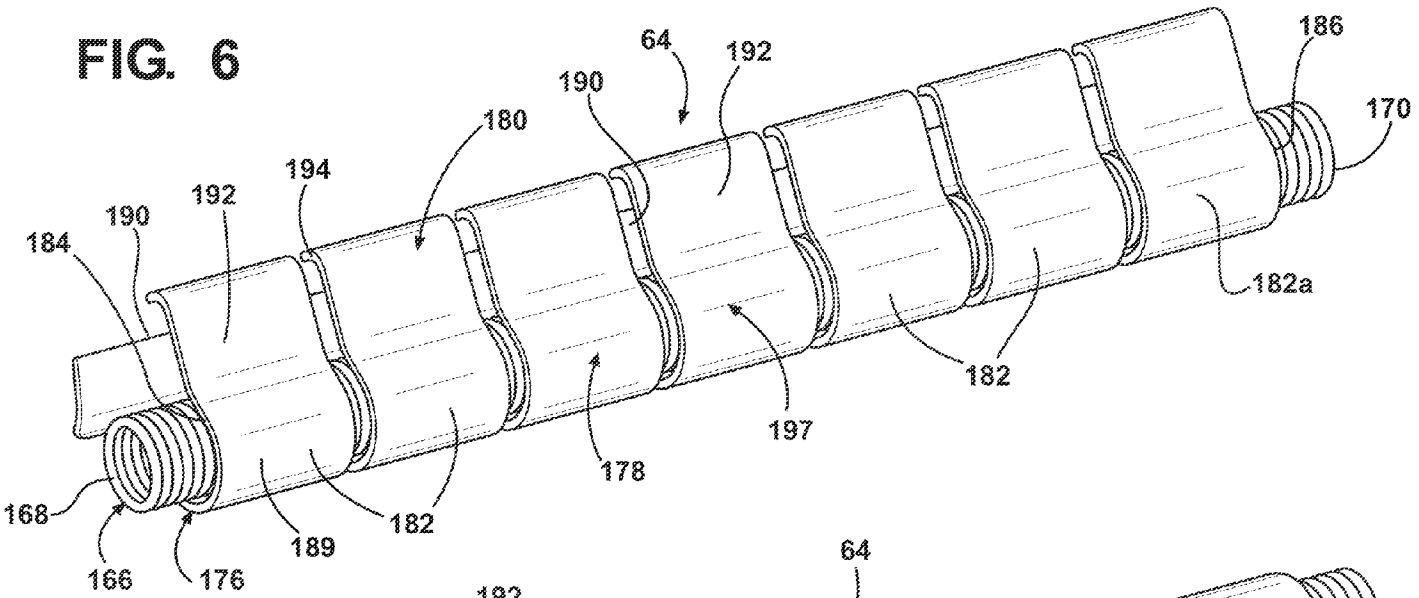
FIG. 6 is a perspective view illustrating a second side of the seal member illustrated in FIG. 5.

Referring to FIGS. 5 and 6, the seal member 64 according to this embodiment comprises a first spring member 166, which, in the embodiment shown, comprises a coil spring member. The first spring member 166 may be formed from a high temperature heat resistant alloy, such as an INCONEL X-750 alloy (INCONEL is a registered trademark of Special Metals Corporation, located in New Hartford, N.Y.), although other suitable materials may be used. The first spring member 166 comprises a first end portion 168 and a second end portion 170 spaced apart from the first end portion 168 in a circumferential direction.

Referring to FIG. 1, when the seal member 64 is employed in the transition channel 62, the first end portion 168 of the seal member 64 according to this embodiment is affixed to the transition seal structure 34 at location 169, although it is noted that the first end portion 168 of the seal member 64 may be affixed to the vane seal structure 38, for example, as shown in the embodiment illustrated in FIG. 11, which will be described below. According to the embodiment shown in FIG. 1, the first end portion 168 of the seal member 64 is affixed to the transition base portion 54 at location 169, although the first end portion 168 of the seal member 64 may be affixed to the first or second lip members 58, 60 in addition to or instead of being affixed to the transition base portion 54. The second end portion 170 of the seal member 64 is not affixed to the either the transition seal structure 34 or the vane seal structure 38, and is thus free to move, e.g., circumferentially, within the transition channel 62 with respect to the transition seal structure 34 and the vane seal structure 38. Such movement between the seal member 64 and the transition seal structure 34 and/or the vane seal structure 38 may occur during operation of the engine.

In this embodiment, each transition seal structure 32 has its own corresponding seal member 64, as shown in FIG. 1. However, it is noted that each transition seal structure 32 may include more than one seal member 64, or, as shown in FIG. 11 and will be discussed below, each seal member 64 may span across more than one adjacent transition seal structures 32.

As shown in FIGS. 5 and 6, the seal member 64 also comprises a sheathing assembly 176. The sheathing assembly 176 comprises a main body portion 178 and a plate portion 180. The main body portion 178 is disposed about at least a substantial length of the first spring member 166.

The main body portion 178 in the embodiment shown is defined by portions of a plurality of adjacent platelets 182, which platelets 182 are arranged in a nested or shiplap configuration about the first spring member 166, as shown in FIGS. 5 and 6. The platelets 182 may be formed from, for example, INCONEL X-750 or a cobalt based alloy. Spacing between adjacent platelets 182 is preferably very minimal so as to limit the amount of fluids that are able to pass through the seal member 64. Further, contact between adjacent platelets 182 may provide a beneficial damping of vibration of the seal member 64.

Figure 5B:
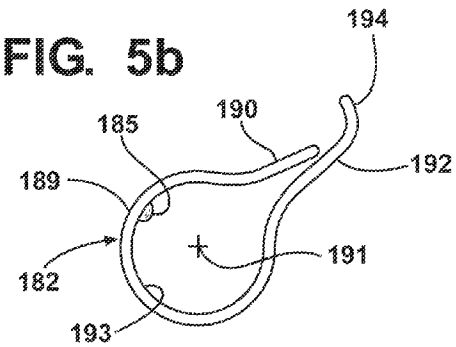
FIG. 5*b* is a side view of one of the platelets of the seal member illustrated in FIG. 5.
Figure 5A:
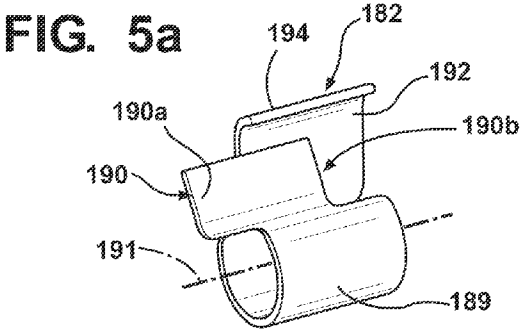
FIG. 5*a* is a perspective view of one of the platelets of the seal member illustrated in FIG. 5.

Referring to FIGS. 5*a* and 5*b*, a single one of the platelets 182 is shown for illustration purposes. The platelet 182 includes a generally circular, or partially circular, platelet body 189 defining a central platelet axis 191. The platelet 182 further includes first and second tabs 190, 192 extending in a generally similar direction from the platelet body 189. The first and second tabs 190, 192 of all the platelets 182, i.e., considered collectively when the platelets 182 are assembled to the seal member 64, form the plate portion 180 of the sheathing assembly 176.

As shown in FIG. 5*a*, the first tab 190 comprises an extension section 190*a* and an extension receiving section 190*b*. The extension section 190*a* is received in the extension receiving section 190*b* of an adjacent platelet 182 (see FIG. 5), such that the extension section 190*a* of each platelet 182 overlaps the second tab 192 of the adjacent platelet 182. The extension section 190*a* of each platelet 182 is received in the extension receiving section 190B of the adjacent platelet 182. Thus, rotation of the platelets 182 may be effected in a manner that will be discussed in detail below.

As shown in FIGS. 5*a* and 5*b*, the second tab 192 includes a curved end portion 194, which curved end portion 194 may form a sealing surface with the vane seal structure 30, as will be discussed below. The second tab 192 in the embodiment shown extends further outwardly than the first tab 190, and is generally close to the first tab 190, see FIG. 5*b*, such that the sheathing assembly 176, as formed by the platelet bodies 189 and tabs 190, 192, substantially surrounds a circumference of the first spring member 166, see FIGS. 5 and 9.

Referring to FIG. 5, a first end 184 of the sheathing assembly 176 is located adjacent to the first end portion 168 of the first spring member 166, but is not affixed thereto. A second end 186 of the sheathing assembly 176, which is spaced from the first end 184 thereof in the circumferential direction, is structurally affixed to the second end portion 170 of the first spring member 166. The structural affixation of the second end 186 of the sheathing assembly 176 to the second end portion 170 of the spring member 166 is effected by a rigid attachment, e.g., by welding, of a last one of the platelets 182*a* to the second end portion 170 of the first spring member 166. Thus, the last one of the platelets 182*a* is structurally tied to the first spring member 166, such that movement of the first spring member 166, e.g., circumferential along the axis of the first spring member 166 and/or rotational movement about the axis of the first spring member 166, causes a corresponding movement of the last one of the platelets 182*a*.

Since the platelets 182 are arranged in a nested configuration, rotational movement of the last one of the platelets 182*a* in a first direction of rotation, e.g., caused by rotational movement of the first spring member 166, causes a corresponding rotational movement of each of the platelets 182 in the first direction. In the embodiment shown in FIG. 5, the first direction of rotation corresponds to the upper portion of the illustrated seal member 64 being rotated into the page in the direction of arrow 167. However, rotational movement of the last one of the platelets 182*a* in a second direction of rotation opposite to the first direction of rotation does not cause a corresponding rotational movement of the other platelets 182. In the embodiment shown in FIG. 5, the second direction of rotation corresponds to the upper portion of the illustrated seal member 64 being rotated out of the page, opposite to the direction of arrow 167. It is noted that, since the platelets 182 are not structurally affixed to one another, circumferential movement of the last one of the platelets 182*a*, i.e., in a direction parallel to the axis 191 of the last one of the platelets 182*a*, in a direction away from the adjacent platelet 182 does not necessarily cause a corresponding movement of the rest of the platelets 182, i.e., the platelets 182 are not circumferentially tied to one another.

Optionally, the platelets 182 may each include a coupling to the first spring member 166, such that circumferential movement of the first spring member 166 causes a corresponding circumferential movement of each of the platelets 182, while rotational movement of the first spring member 166 is not directly tied to the platelets 182 individually. For example, in the embodiment shown, each of the platelets 182 includes a crimped section 185, which crimped section 185 may be implemented with a punch tool (not shown) or other structure that achieves a similar result. The crimped section 185 effects to anchor each platelet 182 to a corresponding axial position on the first spring member 166. That is, an inner wall 193 (FIG. 5*b*) of each platelet 182 is deformed, i.e., pushed toward the first spring member 166, such that the platelets 182 are coupled to the first spring member 166, i.e., the deformed inner wall 193 is wedged between adjacent turns of the coil spring.

Thus, the first spring member 166 and the platelets 182 are coupled to move circumferentially together, i.e., parallel to the axis 191 of the platelets 182, but rotational movement of the first spring member 166 can be performed without corresponding rotational movement of each individual platelet 182, since the deformed inner walls 193 of the platelets 182 may slide between the adjacent turns of the coil spring.

However, as noted above, rotational movement of the first spring member 166 in the first direction of rotation causes a corresponding rotational movement of the last one of the platelets 182*a*, which, in turn causes rotational movement of the remaining platelets 182. But, a circumferential rotation of the last one of the platelets 182*a* in the second direction of rotation does not cause a corresponding rotation of the remaining platelets 182. This occurs as a result of the extension section 190*a* of each of the first tabs 190 of each of the platelets 182 being received in the extension receiving section 190*b* of an adjacent platelet 182, as illustrated in FIGS. 5 and 6. Specifically, as the last one of the platelets 182*a* rotates in the first direction of rotation, the extension section 190*a* of the first tab 190 thereof contacts the second tab 192 of the adjacent platelet 182, which causes the second tab 192 of the adjacent platelet 182, along with the adjacent platelet 182 and its first tab 190, to rotate in the first direction of rotation corresponding to the rotation of the last one of the platelets 182*a*.

The rotation of the first tab 190 of the adjacent platelet 182 causes the extension section 190*a* of the first tab 190 thereof to contact the second tab 192 of the next adjacent platelet 182, which causes a rotation in the first direction of rotation of the next adjacent platelet 182. This rotation is transferred from each platelet 182 to the next platelet 182 until all of the platelets 182 rotate in the first direction of rotation along with the last one of the platelets 182*a*. However, when the last one of the platelets 182*a* rotates in the second direction of rotation, i.e., as a result of the first spring member 166 rotating in the second direction of rotation, the extension section 190*a* of the first tab 190 of the last one of the platelets 182*a* does not contact the second tab 192 of the adjacent platelet 182. Thus, the platelet 182 adjacent to the last one of the platelets 182*a* is not caused to rotate in the second direction of rotation along with the last one of the platelets 182*a*.

It is noted that, while each of the platelets 182 illustrated in FIGS. 5-8 has a substantially identical shape, some of the platelets 182 could comprise different shapes without departing from the spirit and scope of the invention. For example, the last one of the platelets 182*a* need not include an extension receiving section 190*b*, since the last one of the platelets 182*a* does not receive an extension section 190*a* of an adjacent platelet 182. Further, the platelet 182 that defines the first end 184 of the sheathing assembly 176 need not include an extension section 190*a*, since this platelet 182 does not transfer rotational movement to an adjacent platelet 182.

Referring to FIG. 9, when the seal member 64 is in a desired position in the channel 121, the plate portion 180 extends from the sheathing assembly main body portion 178 toward the vane seal structure 38, and the curved end portions 194 of the platelets 182 engage the vane base portion 112 of the vane seal structure 38. As will be discussed in detail below, a preloading of the first spring member 166 causes the first spring member 166 to provide a bias on the sheathing assembly 176, such that the plate portion 180 engages the vane base portion 112 of the vane seal structure 38 to limit leakage through the common channel 121 between the transition seal structure 34 and the vane seal structure 38, as will be discussed below. Further, movement of the first end portion 168 of the first spring member 166 relative to the second end portion 170 creates a restorative spring force, e.g., circumferential or rotational movement, which opposes the movement between the first and second end portions 168, 170. The spring force is proportional to the amount of movement between the first and second end portions 168, 170.

It is noted that, a first side 195 of the seal member 64, which is illustrated in FIG. 5, corresponds to a side of the seal member 64 that faces an area containing cooling fluid, i.e., area 26, and a second side 197 of the seal member 64 illustrated in FIG. 6, corresponds to a side of the seal member 64 that faces the hot gas path 22. However, the sides may be switched without departing from the spirit and scope of the invention.

Figure 7:
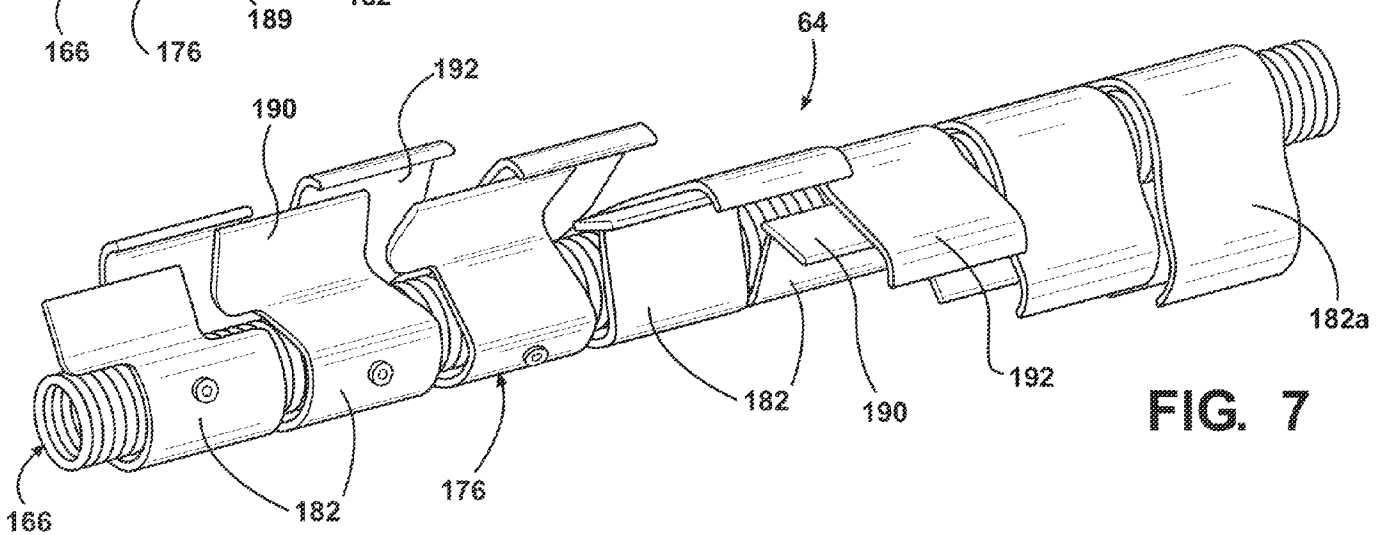
FIG. 7 is a perspective view illustrating the seal member illustrated in FIG. 5 shown in a second position.

Referring now to FIGS. 5-7, the seal member 64 may be situated in one of at least two positions. That is, the seal member 64 may situated in a first position, illustrated in FIGS. 5 and 6, and in a second position, illustrated in FIG. 7. The first position may correspond to an engaged position of the seal member 64 when the seal member 64 is disposed in the channel 121 and affixed to the transition seal structure 34, as will be discussed in detail herein. The second position may correspond to a non-engaged position, where the first spring member 166 is in an un-preloaded state.

While in the first position, the first spring member 166 is in a preloaded state. The preloaded state may be achieved by rotating the first end portion 168 of the first spring member 170 with respect to the second end portion 170 until a sufficient amount of bias can be applied by the first spring member 166 on the sheathing assembly 176, i.e., such that the plate portion 180 is capable of forming a substantially fluid tight seal with the vane seal structure 38. It is noted that, while in its first position, the tabs 190, 192 of the platelets 182 are substantially aligned to form a substantially straight member extending from the first end 184 to the second end 186 of the sheathing assembly 176.

Once the seal member 64 is caused to be situated in its first position, i.e., by preloading the first spring member 166, the seal member 64 can be maintained in its preloaded state until it is arranged in its desired position within the channel 121, which will be described below, with the use of a holding structure 196, shown in FIG. 8. The holding structure 196 in the embodiment shown comprises a band-member 199*a* that securely holds the first and second tabs 190, 192 of the platelets 182 generally aligned with each other to prevent rotational movement thereof. The holding structure 196 according to this embodiment also comprises a tapered plug member 199*b* that is securely affixed to the first end portion 168 of the first spring member 166, i.e., by an insertion of the tapered plug member 199*b* into an interior section of the first spring member 166 until the outer wall of the tapered plug member 199*b* is securely held by the first end portion 168 of the first spring member 166. The plug member 199*b* may be rigidly affixed to the band-member 199*a* via a rigid spanning member 199*c*, such that plug member 199*b* and the first end portion 168 of the first spring member 166 are prevented from rotating with respect to the band-member 199*a*, and, thus, are prevented from rotating with respect to the platelets 182. Since the last one of the platelets 182*a* is affixed to the second end portion 170 of the first spring member 166, the platelets 182 are prevented from rotating with respect to the second end portion 170 of the first spring member 166, such that the holding structure 196 need not be affixed to the second end portion 170 of the first spring member 166.

The holding structure 196 may be a temporary member that is adapted to be removed from the seal member 64 subsequent to the seal member 64 being arranged in its desired position. The holding structure 196 according to the embodiment shown may be formed from a material that cannot withstand the high temperature environment of the turbine section 20 of the engine during operation thereof, such as, for example, a rigid and high-strength plastic. Thus the removal of the holding structure 196 may be facilitated by a burning thereof upon operation of the engine, i.e., as a result of the holding structure 196 being exposed to the high temperatures of combustion gases entering the turbine section 20 from the transition ducts 18.

Upon the removal of the holding structure 196, the first and second tabs 190, 192 of the platelets 182 and the first end portion 168 of the first spring member 166 are released, such that the first spring member 166 provides a bias on the sheathing assembly 176. The bias on the sheathing assembly 176 causes the plate portion 180 to engage the vane base portion 112 of the vane seal structure 38 to form a substantially fluid tight seal therebetween. It is understood that the removal of the holding structure 196 illustrated herein, or other types of holding structures used to maintain the seal member 64 in its first position, may be accomplished in any suitable manner, such as, for example, a manual removal.

Referring to FIG. 7, while in its second position, the first spring member 166 is in a relaxed and un-preloaded state, and provides little or no bias against the sheathing assembly 176. Due to the relaxed and un-preloaded state of the first spring member 166, the platelets 182 of the sheathing assembly 176 may be spaced from each other around the first spring member 166, as illustrated in FIG. 7.

Upon a rotation of the second end portion 170 of the first spring member 166 with respect to the first end portion 168, the seal member 64 is gradually changed from its second position into its first position, at which time the holding structure 196 may be applied to maintain the first spring member 166 in its first position until the seal member 64 is disposed within the channel 121 and affixed to the transition seal structure 34, as will be discussed below. Specifically, rotating the second end portion 170 of the first spring member 166 with respect to the first end portion 168 thereof in the first direction of rotation (corresponding to the arrow 167 in FIG. 5), causes a corresponding rotation of the last one of the platelets 182*a*, i.e., due to the affixation of the last one of the platelets 182*a* to the first spring member 166. The extension portion 190*a* of the first tab 190 of the last one of the platelets 182 contacts the second tab 192 of the adjacent platelet 182, which, upon further rotation of the second end portion 170 of the first spring member 166 with respect to the first end portion 168 thereof in the first direction of rotation, causes a rotation of the adjacent platelet 182 in the first direction of rotation. Continued rotation of the second end portion 170 of the first spring member 166 with respect to the first end portion 168 thereof in the first direction of rotation gradually causes the extension portion 190*a* of each of the platelets 182 to contact the second tab 192 of the adjacent platelet 182, until all of the platelets 182 are situated with their first and second tabs 190, 192 substantially aligned to form the substantially straight member as described above.

Figure 8:
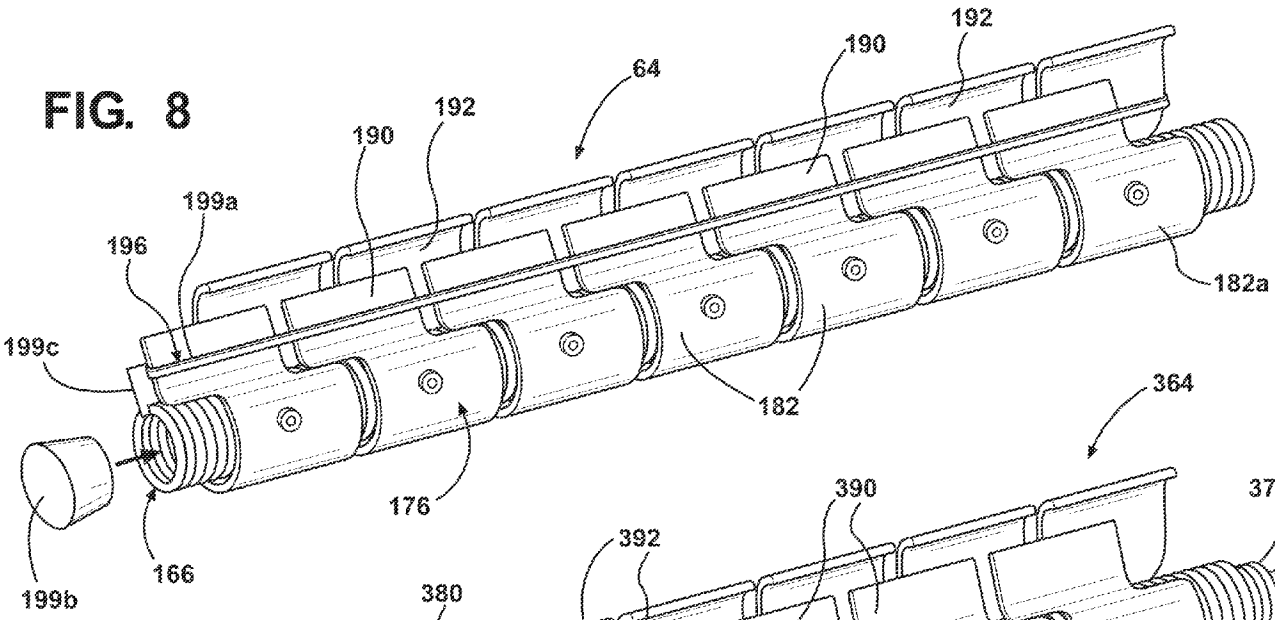
FIG. 8 is a perspective view of the seal member illustrated in FIG. 5 shown being maintained in the first position.

It is noted that the invention could be practiced without the use of the holding structure 196 illustrated in FIG. 8, which secures the first end portion 168 of the first spring member 166 to the band-member 199*a* via the plug member 199*b* and the spanning member 199*c*. For example, if the first end portion 168 of the first spring member 166 is attached to the transition seal structure 34 prior to the pre-loading of the first spring member 166, i.e., from its second position to its first position, as discussed above, the first and second tabs 190, 192 of the platelets 182 merely need to be prevented from rotating so as to not allow the first spring member 168 to unload. This could be effected with a tape structure (not shown), which could be used to secure the platelets 182 to the transition seal structure 34. The removal of the tape structure may be facilitated by a burning thereof upon operation of the engine, i.e., as a result of the tape structure being exposed to the high temperatures of combustion gases entering the turbine section 20 from the transition ducts 18. Upon a burning of the tape structure, the plate portion 180 would move into engagement with the vane base portion 112 of the vane seal structure 38 via the pre-loaded condition of the first spring member 166.

It is noted that the first spring member 166 comprises a flexible member. Moreover, since the sheathing assembly 176 is formed from a plurality of separately formed platelets 182 that are capable of moving relative to one another as discussed above, the sheathing assembly 176 comprises a generally flexible member. Thus, bending of the first spring member 166 and of the sheathing assembly 176 is permitted, such that the seal member 64 is able to conform to the bended shape of the transition channel 62, see FIG. 1.

FIGS. 9 and 10 illustrate a seal apparatus 30 formed by the transition seal structure 34, the vane seal structure 38, and the seal member 64 described herein with reference to FIGS. 1-8. It is noted that, in FIG. 10, the transition ducts 18 associated with the transition seal structures 32 and 34 have been removed for clarity.

The seal apparatus 30 according to this embodiment is assembled by an axial installation of at least one of the first row vane assembly 15 and the transition ducts 18 in a direction toward one another until the vane seal structure 38 and the transition seal structure 34 reach a desired position with respect to one another. This axial installation results in the formation of the illustrated seal apparatus 30 (and the formation of the other seal apparatuses 28, 30), i.e., by the bringing together of the transition seal structure 34 and the vane seal structure 38 such that the transition lip members 58, 60 axially overlap the vane lip members 116, 118. The overlapping lip members 58, 116 and 60, 118, in combination with the transition channel 62 and the vane channel 120, form a labyrinth path Lp (see FIG. 9) for fluids passing through the seal apparatus 30, thus reducing leakage through the seal apparatus 30 and the corresponding seal system 11. Further, the seal member 64, which, at the time of installation, may be held in its first position by the holding structure 196 (not shown in FIG. 9 or 10), is caused to be surrounded within the common channel 121, which, as noted above, comprises portions of both the transition channel 62 and the vane channel 120. More specifically, the common channel 121 is defined by the transition base portion 54, the transition lip members 58, 60, the vane base portion 112, and the vane lip members 116, 118. Once the seal member 64 is surrounded within the common channel 121, the holding structure 196 may be removed, as discussed above. Once the holding structure 196 is removed, the bias of the first spring member 166 provided to the sheathing assembly 176 forces the plate portion 180 to substantially remain engaged to the vane base portion 112 of the vane seal structure 38. It is noted that the seal member 64 may be inserted into the transition channel 62 and affixed to the transition seal structure 34 prior to the transition seal structure 34 being affixed to the transition duct 18 or subsequent to the transition seal structure 34 being affixed to the transition duct 18.

The seal systems 10, 11 described herein limit leakage between the hot gas path 22 and the areas 24, 26, which, as noted above contain cooling fluid for structure within the engine to be cooled. For example, since the lip members 58, 60 of the transition seal structures 32, 34 axially overlap the lip members 116, 118 of the vane seal structures 36, 38, the labyrinth path $L_P$ is formed to minimize leakage. Additionally, since the seal member 64 is captured between the lip members 58, 60 and 116, 118, and the plate portion 180 engages the vane seal structure 38, leakage is further reduced.

It is noted that, due to the location of the seal member 64, i.e., isolated within the common channel 121 between the lip members 58, 60 and 116, 118 and the transition and vane base portions 54, 112, it is believed that introduction into the turbine section 20 of any pieces of the seal member 64 resulting from damage/breakage of the seal member 64 will be minimized or reduced. The reduction of pieces of the seal member 64 that may be introduced into the turbine section 20 is believed to increase a lifespan of the engine, as broken off pieces of the seal member 64 could cause damage to the structure in the turbine section 20.

Further, since the second end portions 170 of the seal members 64 are not attached to the transition seal structures 32, 34 or the vane seal structures 36, 38, the second end portions 170 of the seal members 64 are free to move circumferentially within their respective common channel 121. Thus, any relative movement between the seal members 64 and the transition seal structures 32, 34 and/or the vane seal structures 36, 38 can be accommodated by movement of the free second end portions 170 of the seal members 64 with respect to the transition seal structures 32, 34 and/or the vane seal structures 36, 38. Thus, thermally induced stresses between the seal members 64 and the transition seal structures 32, 34 and/or the vane seal structures 36, 38, which could otherwise be caused by relative movement between the seal members 64 and the transition seal structures 32, 34 and/or the vane seal structures 36, 38 if these structures were structurally attached to one another, are substantially avoided.

Additionally, since the seal members 64 in the embodiment shown are rigidly affixed to the transition seal structures 32, 24, but not to the vane seal structures 36, 38, forces transferred between the transition seal structures 32, 24 and the vane seal structures 36, 38 via the seal members 64 are believed to be reduced. That is, forces transferred between the transition seal structures 32, 24 and the vane seal structures 36, 38 via the seal members 64 are believed to be limited to frictional forces, i.e., caused by the seal members 64 rubbing against the vane seal structures 36, 38, wherein rigid full-force transmission, i.e., binding forces, between the transition seal structures 32, 24 and the vane seal structures 36, 38, e.g., caused by thermal growth of either or both of the transition seal structures 32, 24 and the vane seal structures 36, 38, is believed to be avoided. Moreover, even in the case of thermal growth of either or both of the transition seal structures 32, 24 and the vane seal structures 36, 38, the seal members 64 are capable of effecting a substantially fluid tight seal therebetween.

Figure 11:
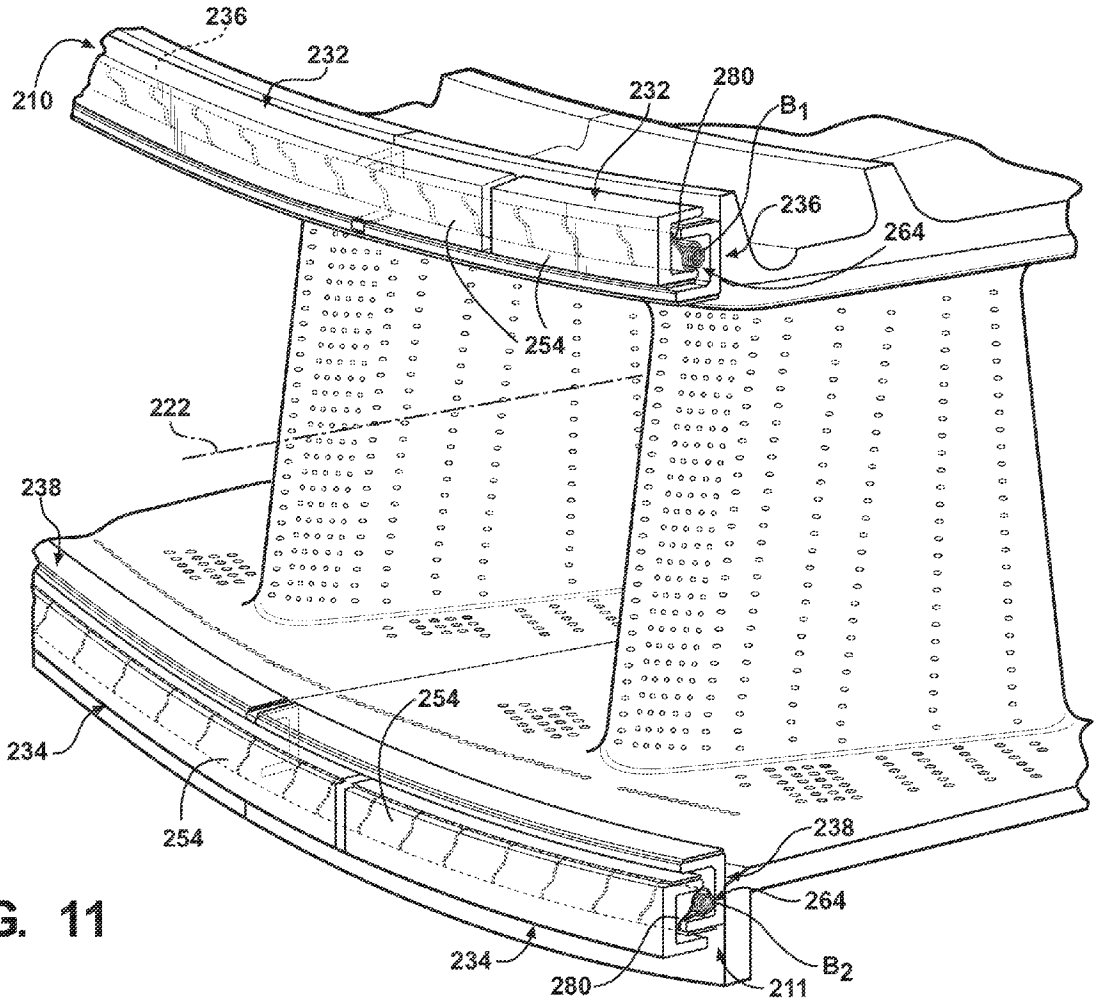
FIG. 11 is a fragmentary perspective view of a plurality of the transition seal structures illustrated in FIG. 1, shown removed from their corresponding transition ducts, cooperating with a plurality of the vane seal structures illustrated in FIG. 3 and with seal members according to another embodiment of the invention to form seal apparatuses of seal systems according to embodiments of the invention.

Referring now to FIG. 11, seal systems 210 and 211 including seal members 264 according to another embodiment of the invention are illustrated, where structure similar to that described above with reference to FIGS. 1-10 includes the same reference number increased by 200. In this embodiment, the seal members 264 are affixed to vane seal structures 236 and 238 at locations $B_1$ and $B_2$, respectively, rather than being affixed to transition seal structures 232 and 234 as discussed above with reference to FIGS. 1-10. Plate portions 280 of the seal members 264 according to this embodiment engage transition base portions 254 of the transition seal structures 232 and 234 to limit leakage through the respective seal systems 210 and 211.

Further, rather than each seal member 264 corresponding to a single transition seal structure 232 or 234 as described above with reference to FIGS. 1-10, each seal member 264 spans between a plurality of the transition seal structures 232 and 234 and between a plurality of the vane seal structures 236 and 238. The seal members 264 according to this embodiment may span between as many transition seal structures 232 and 234 and vane seal structures 236 and 238 as desired, including, for example, one transition seal structure 232 or 234 or one vane seal structure 236 or 238, two transition seal structures 232 or 234 or two vane seal structures 236 or 238 . . . N transition seal structures 232 or 234 or N vane seal structures 236 or 238, where N represents the total number of transition seal structures 232 or 234 or vane seal structures 236 or 238 included in the respective seal system 210 or 211.

It is noted that, in this embodiment, the arrangement of the transition seal structures 232 and 234 and vane seal structures 236 and 238 is different than in the embodiment described above with reference to FIGS. 1-10. That is, in this embodiment, the vane seal structures 236 and 238 are radially closer to a hot gas path 222 than are the transition seal structures 232 and 234. Thus, lip members of the vane seal structures 236 and 238 that are closest to the hot gas path 222 may include thermal barrier coatings (not shown) to protect the vane seal structures 236 and 238 from the high temperatures of the hot gas path 222. Further, the lip members of the transition seal structures 232 and 234 may include abradable coatings (not shown) in the case of contact between the lip members of the transition seal structures 232 and 234 and vane seal structures 236 and 238.

Remaining structure is substantially similar to that described above with reference to FIGS. 1-10 and will not be described in detail herein.

Figure 12:
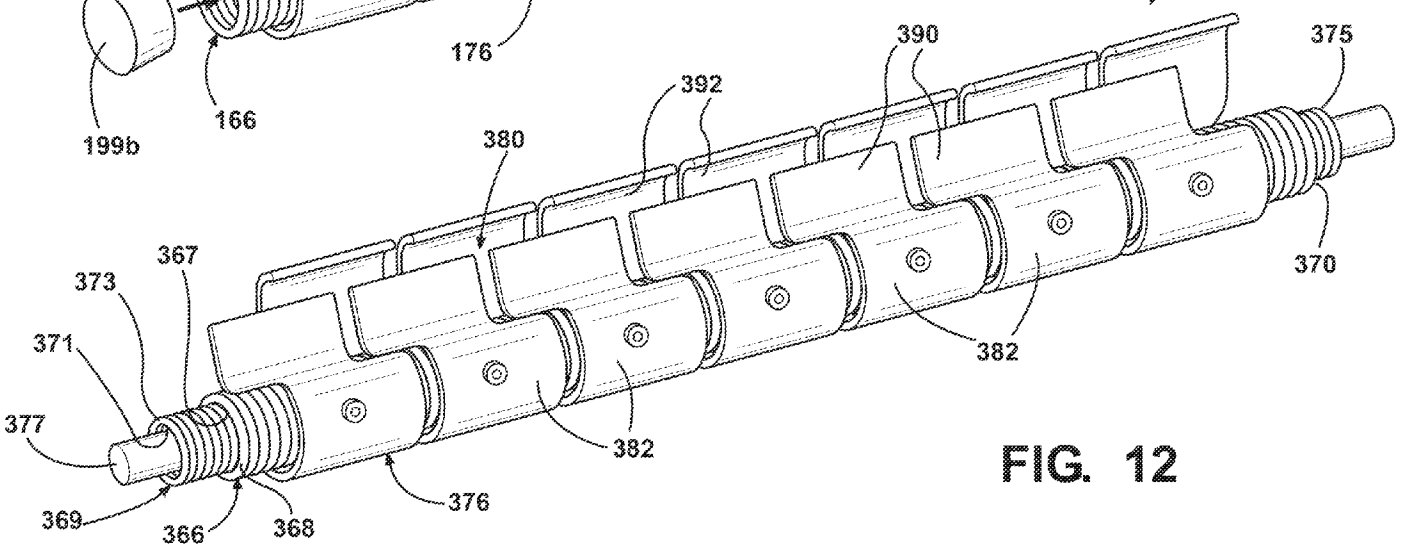
FIG. 12 is a perspective view of a seal member according to yet another embodiment of the invention.

Referring now to FIG. 12, a seal member 364 according to another embodiment of the invention is shown, where structure similar to that described above with reference to FIGS. 1-10 includes the same reference number increased by 300. In this embodiment, a first spring member 366 defines an inner volume 367 from a first end portion 368 thereof to a second end portion 370 thereof. A first damper member 369 is disposed in the inner volume 367 of the first spring member 366, which first damper member 369 may extend circumferentially beyond the first and second end portions 368, 370 of the first spring member 366. In the embodiment shown, the first damper member 369 comprises a second spring member, although other types of damper members may be provided. The first damper member 369 effects a damping of vibratory movement of the seal member 364, such as may occur during operation of a gas turbine engine in which the seal member 364 is employed. Damping of the vibratory movement of the seal member 364 may increase the lifespan of the seal member 364, as vibratory movement of the seal member 364 may result in breaking thereof.

Further, if pieces of the seal member 364 do break, the first damper member 369, which may comprise a relatively strong member, may stay intact and thus prevent the seal member pieces from entering a turbine section of the engine in which the seal member is employed. Additionally, the first damper member 369 provides structural stiffening and torsional rigidity to the seal member 364. Moreover, the first damper member 369 may reduce leakage though the seal member 364, i.e., by taking up space within the inner volume 367 of the first spring member 366 through which fluids may otherwise travel through the seal member 364.

The first damper member 369 in the embodiment shown defines an interior volume 371 from a first end portion 373 thereof to a second end portion 375 thereof. A second damper member 377 is disposed in the interior volume 371 of the first damper member 369, which second damper member 377 may extend circumferentially beyond the first and second end portions 373, 375 of the first damper member 369. The second damper member 377 in the embodiment shown may comprise a high strength and high temperature wire, such as a INCONEL X-750 wire, although other suitable damper members may be used.

The second damper member 377 provides additional damping of vibratory movement of the seal member 364, and provides further protection against seal member pieces being introduced into the turbine section of the engine. Moreover, the second damper member 377 may reduce leakage though the seal member 364, i.e., by taking up space within the interior volume 371 of the first damper member 369 through which fluids may otherwise travel through the seal member 364.

Remaining structure is substantially similar to that described above with reference to FIGS. 1-10 and will not be described in detail herein While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal member in a channel between a transition seal structure associated with a transition duct and a vane seal structure associated with a vane structure in a first row vane assembly of a gas turbine engine, said seal member comprising:

a first spring member extending in a circumferential direction within the channel, said first spring member comprising a first end portion and a second end portion spaced apart from said first end portion in the circumferential direction, said first end portion affixed to a first one of the transition seal structure and the vane seal structure, said second end portion free to move circumferentially within the channel with respect to the transition seal structure and the vane seal structure; and a sheathing assembly comprising a main body portion and a plate portion, said main body portion disposed about at least a substantial portion of said first spring member and being affixed to said second end portion of said first spring member, said plate portion extending from said main body portion toward a second one of the transition seal structure and the vane seal structure different than said first one of the transition seal structure and the vane seal structure, wherein said first spring member provides a bias on said sheathing assembly such that said plate portion engages said second one of the transition seal structure and the vane seal structure to limit leakage through the channel between the transition seal structure and the vane seal structure.

2. The seal member of claim 1, wherein said first spring member is a coil spring.

3. The seal member of claim 2, wherein said coil spring is preloaded by a rotation of said second end portion with respect to said first end portion to provide the bias on said sheathing assembly.

4. The seal member of claim 1, wherein said sheathing assembly comprises a plurality of adjacent platelets capable of moving relative to each other such that said sheathing assembly comprises a flexible member.

5. The seal member of claim 4, wherein each said platelet comprises a platelet body and first and second tabs, said first and second tabs of each of said platelets collectively defining said plate portion.

6. The seal member of claim 5, wherein said second tab of each said platelet engages said first tab of an adjacent platelet.

7. The seal member of claim 4, wherein said platelets are each structurally coupled to said first spring member such that said platelets and said first spring member move circumferentially together.

8. The seal member of claim 1, wherein said first spring member defines an inner volume, and further comprising a first damper member disposed in said inner volume for providing damping of vibratory movement of the seal member.

9. The seal member of claim 8, wherein said first damper member comprises a second spring member, wherein said second spring member provides structural stiffening and torsional rigidity to the seal member.

10. The seal member of claim 8, wherein said first damper member defines an interior volume, and further comprising a second damper member disposed in said interior volume for providing additional damping of vibratory movement of the seal member.

11. The seal member of claim 10, wherein said second damper member comprises a high strength and high temperature wire.

12. A seal apparatus in a gas turbine engine between a transition duct and a vane structure in a first row vane assembly, said seal apparatus comprising:

a transition seal structure associated with the transition duct;

a vane seal structure associated with the vane structure, wherein said transition seal structure and said vane seal structure are positioned so as to define a circumferentially extending channel therebetween; and a seal member located in said channel between said transition seal structure and said vane seal structure for limiting leakage through said channel, said seal member comprising:

a first spring member having a first end portion and a second end portion spaced apart from said first end portion in the circumferential direction, said first end portion affixed to a first one of said transition seal structure and said vane seal structure, said second end portion free to move circumferentially within said channel with respect to said transition seal structure and said vane seal structure; and a sheathing assembly associated with said first spring member, said sheathing assembly affixed to said second end portion of said first spring member and including a circumferentially extending plate portion, wherein said first spring member provides a bias on said sheathing assembly such that said plate portion engages the other of said transition seal structure and said vane seal structure to limit leakage through said channel between said transition seal structure and said vane seal structure.

13. The seal apparatus of claim 12, wherein:

said transition seal structure includes a pair of spaced apart, axially extending transition lip members and a transition base portion that spans between said transition lip members;

said vane seal structure includes a pair of spaced apart, axially extending vane lip members and a vane base portion that spans between said vane lip members;

said transition lip members overlap said vane lip members in an axial direction;

said channel is located between said transition lip members, said transition base portion, said vane lip members, and said vane base portion; and said seal member is surrounded within said channel by said transition lip members, said transition base portion, said vane lip members, and said vane base portion.

14. A seal member for use in a channel between a transition seal structure associated with a transition duct and a vane seal structure associated with a vane structure in a first row vane assembly of a gas turbine engine, said seal member comprising:

a first spring member comprising a first end portion and a second end portion spaced apart from said first end portion, said first end portion adapted to be affixed to a first one of the transition seal structure and the vane seal structure, said second end portion free to move circumferentially when disposed within the channel with respect to the transition seal structure and the vane seal structure; and a sheathing assembly comprising a main body portion and a plate portion, said main body portion disposed about at least a substantial portion of said first spring member and being affixed to said second end portion of said first spring member, said plate portion extending from said main body portion and being adapted to extend toward a second one of the transition seal structure and the vane seal structure different than the first one of the transition seal structure and the vane seal structure, wherein said first spring member is adapted to provide a bias on said sheathing assembly such that said plate portion engages the second one of the transition seal structure and the vane seal structure to limit leakage through the channel between the transition seal structure and the vane seal structure.

15. The seal member of claim 14, wherein said first spring member is a coil spring.

16. The seal member of claim 15, wherein said coil spring is preloaded by a rotation of said second end with respect to said first end to provide the bias on said sheathing assembly.

17. The seal member of claim 16, further comprising a holding structure for maintaining said coil spring in a preloaded state.

18. The seal member of claim 17, wherein said holding structure comprises a temporary member that is adapted to be removed from the seal member subsequent to the seal member being arranged in a desired position.

19. The seal member of claim 14, wherein said sheathing assembly comprises a plurality of adjacent platelets capable of moving relative to each other such that said sheathing assembly comprises a flexible member, and wherein said plate portion is formed from tabs of said plurality of platelets.

20. The seal member of claim 19, wherein each said platelet comprises a platelet body and first and second tabs, said first and second tabs of each of said platelets collectively defining said plate portion, and wherein said second tab of each said platelet engages said first tab of an adjacent platelet.

* * * * *